US008646199B2

(12) United States Patent
Norman et al.

(10) Patent No.: US 8,646,199 B2
(45) **Date of Patent: *Feb. 11, 2014**

(54) SHRINK WRAP EYEGLASSES TAG WITH HOOK

(75) Inventors: Michael Norman, East Brunswick, NJ (US); Jake Strassburger, South Plainfield, NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/215,574

(22) Filed: Aug. 23, 2011

(65) Prior Publication Data

US 2012/0048946 A1 Mar. 1, 2012

Related U.S. Application Data

(60) Provisional application No. 61/376,934, filed on Aug. 25, 2010.

(51) Int. Cl.
*G09F 3/08* (2006.01)

(52) U.S. Cl.
USPC ..... 40/662; 340/572.9

(58) Field of Classification Search
USPC ..... 40/662, 316; 211/85.1; 248/902
See application file for complete search history.

(56) References Cited

U.S. PATENT DOCUMENTS

| | | | | |
|---|---|---|---|---|
| 5,537,765 | A * | 7/1996 | Liebman et al. | 40/673 |
| 5,988,462 | A * | 11/1999 | Kolton | 223/85 |
| 6,145,167 | A * | 11/2000 | Brentini | 24/3.1 |
| 6,317,046 | B1 * | 11/2001 | Fresnel et al. | 340/572.9 |
| 6,330,758 | B1 | 12/2001 | Feibelman | |
| 6,518,888 | B1 | 2/2003 | Kolton et al. | |
| 7,804,408 | B2 | 9/2010 | Kolton et al. | |
| 2007/0273535 | A1 * | 11/2007 | Kolton et al. | 340/572.8 |
| 2008/0272917 | A1 * | 11/2008 | Feibelman et al. | 340/572.9 |

* cited by examiner

*Primary Examiner* — Kristina Junge
(74) *Attorney, Agent, or Firm* — Hoffman & Baron, LLP

(57) ABSTRACT

A tag assembly for securing a tag to a pair of eyeglasses, wherein the eyeglasses have a frame for holding a pair of lenses and two hinged legs. The tag assembly includes a tag, a shrink tube and optionally an electronic identification device ("EID"), a hook, an information panel and a substantially flat pad. The body of the tag is inserted into the opening in the shrink tube and the tag assembly receives one of the first hinged legs of the pair of eyeglasses. The shrink tube secures the hinged leg in the tag assembly upon the application of heat.

20 Claims, 5 Drawing Sheets

SHRINK WRAP EYEGLASSES TAG WITH HOOK

This application claims priority from provisional application Ser. No. 61/376,934, filed on Aug. 25, 2010, which is incorporated herein in its entirety.

FIELD OF THE INVENTION

The present invention relates to tags that are used in the packaging and display of merchandise. In particular, the present invention relates to tags that are secured to eyeglasses and hung from merchandise displays.

BACKGROUND OF INVENTION

Small articles are commonly displayed for sale in retail stores on racks or in display cases where the articles are hung. A variety of different devices and tags have been used that are secured to the article and have a means for attachment to the rack or display. The design criteria for these tags include low manufacturing costs and easy and efficient attachment of the tags to the articles. The tags must also be convenient for the merchant to display and they must be convenient for the customer to remove after purchase.

Tags used for displaying eyeglasses must be designed so that the customer can easily view the eyeglasses and remove them from the display rack. The tags must also be designed so that the customer can easily try on the eyeglasses without having to remove the tag. Because a customer may try on several pairs of eyeglasses before making a selection, the tags must be designed so that they can be removed from the display and then put back in place by the customer numerous times without damaging either the eyeglasses or the tags.

Tags often include radio frequency identification (RFID) devices or electronic article surveillance (EAS) devices, which are referred to herein collectively as "electronic identification devices" ("EID"). Tags that incorporate an ED are attached to articles and have a wide variety of uses, including tracking, inventory control and security. These electronic tags can also provide electronically readable information pertaining to the articles. EAS tags may be used with an alarm system to provide theft deterrence by monitoring the location of the tags and any unauthorized movement of the article containing the EAS tag from a predetermined area. The tags can be enclosed in or attached to a variety of different devices, such as holders or housings, which accommodate the electronic tag and are used to attach the tags to articles. The tags are secured to the article so that they remain with the article until after the time of purchase.

Accordingly, there is a need for a tag for displaying eyeglasses that can be easily removed and reinstalled in the display and that does not prevent the eyeglasses from being worn by a customer. There is also a need for a tag for displaying eyeglasses that can be economically manufactured and easily and firmly secured to the eyeglasses. In addition, there is a need for a tag for displaying eyeglasses that has an integral electronic identification device.

SUMMARY OF THE INVENTION

In accordance with the present invention, a tag assembly for securing a tag to a pair of eyeglasses is provided. The eyeglasses typically have a frame for holding a pair of lenses and first and second hinged legs. The tag assembly includes a tag, a shrink tube and optionally an electronic identification device ("EID"), a hook, an information panel and a substantially flat pad. The tag includes a body having a first end, a second end, a front surface and a rear surface. The body can also include a hook extending from the first end of the body and a pair of slotted members that extend from the rear surface of the body. Preferably, the slotted members are substantially parallel to each other and the slots are located on the sides of the slotted members and face each other.

The information panel can be located on the first end of the body adjacent to the hook. The flat pad has a first adhesive side and a second friction side. The adhesive side of the pad is placed in contact with the front surface of the body and secures the pad to the front surface of the body. The first hinged leg is received between the friction side of the pad and the shrink tube.

The electronic identification device has opposing side edges that are slidably inserted into the slotted members of the body. The electronic identification device can be a radio frequency identification (RFID) device or an electronic article surveillance (EAS) device. The EID allows the eyeglasses to be easily identified for inventory and security purposes.

The shrink tube has a side wall, a first end, a second end and an opening extending therebetween. The shrink tube can be made from polypropylene, polyvinyl chloride (PVC) or polyethylene and can have a length that is substantially the same as the length of the body. The body of the tag, with or without the BID attached thereto, is inserted into the opening in the shrink tube and the tag assembly receives one of the first hinged legs of the pair of eyeglasses between the body and the shrink tube. The shrink tube secures the hinged leg in the tag assembly upon the application of heat.

BRIEF DESCRIPTION OF THE FIGURES

The preferred embodiments of the shrink-wrap eyeglasses tag with hook of the present invention, as well as other objects, features and advantages of this invention, will be apparent from the accompanying drawings wherein.

DETAILED DESCRIPTION OF THE INVENTION

Figure 1:
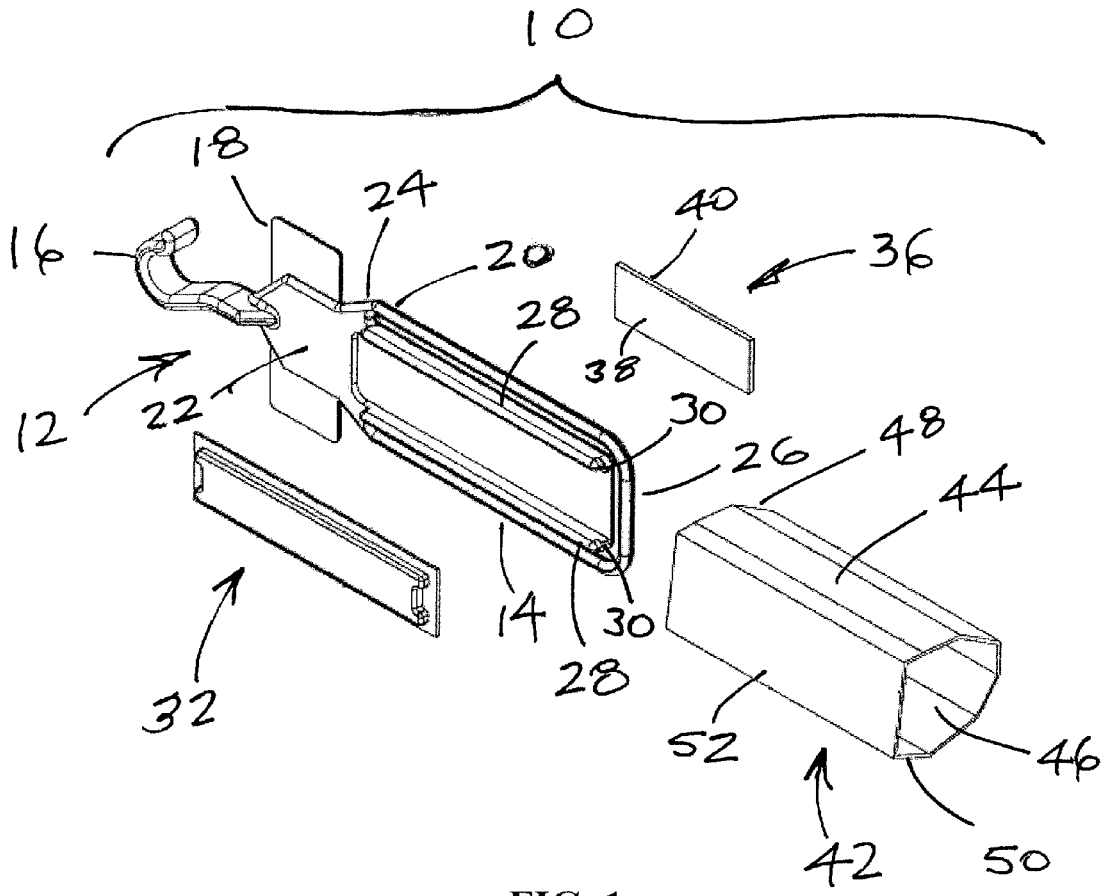
FIG. 1 is an exploded perspective view of an embodiment of the shrink-wrap eyeglasses tag assembly of the present invention.

The present invention is a shrink-wrap eyeglasses tag assembly. The tag assembly is used for securing a tag to a pair of eyeglasses having a frame and two hinged legs. The tag assembly includes a tag, a shrink tube and optionally an electronic identification device and a substantially flat pad. The tag includes a body having a first end, a second end, a front surface, a rear surface, an information panel and a hook extending from the first end of the body. The hook may be used for attaching the tag to a structure, such as a rack or a support member in a display. The body is substantially planar and can have a pair of slotted members extending from the rear surface. The information panel is located between the body of the tag and the hook. Preferably, the tag is made from a hard plastic or nylon material. The information panel can contain indicia or information relating to the article attached to the tag and the information may be on a label secured to the information panel with, for example an adhesive such as pressure-sensitive glue. The electronic identification device ("EID") has opposing side edges and is inserted into the slotted members, which are adapted to receive the opposing side edges and secure the device in place. The EID can contain information relating to the merchandise attached to the tag and/or provide anti-theft protection.

The substantially flat pad has a first adhesive side and a second friction side. The adhesive side is used to secure the pad to the front surface of the body. The friction side is formed from a material with a high coefficient of friction, such as a soft rubber, and is used to frictionally engage one of the legs of the eyeglasses after heat is applied to the shrink tube. In some embodiments, the flat pad is not used and the eyeglasses are secured to the tag by the heat shrink tube alone.

The shrink tube has a side wall, a first end, a second end and an opening extending between the two ends. The shrink tube is made of a plastic material, preferably a transparent and biaxially oriented plastic material, which shrinks when exposed to a heat source. The amount of heat required to shrink the shrink tube depends on the type and thickness of the plastic that is used to construct the shrink tube. The criteria for selecting the plastic material and the amount of heat required to shrink the plastic are well known to those of ordinary skill in the art of packaging using heat shrinkable plastic materials. Polypropylene is the preferred plastic material for construction of the shrink tube. However, other heat shrinkable plastic materials, including polyvinyl chloride (PVC) and polyethylene, can also be used.

The shrink tube has a generally cylindrical shape and a length that is substantially the same as the length of the body of the tag. In one embodiment, the side wall of the shrink tube has a substantially flat portion with side edges that are connected by a plurality of flat panels that have the shape of the letter "D." When the body of the tag is inserted in the shrink tube, the flat side wall portion corresponds to the rear surface of the body. In another embodiment, the shrink tube has a substantially circular cross-section. However, the invention is not limited by the shape of the shrink tube and any shrink tube that snugly fits around the tag after the application of heat can be used.

The tag assembly is attached to a pair of eyeglasses after the EID is inserted into the slotted members on the rear surface of the body and the adhesive side of the pad is positioned on the front surface of the body. The body of the tag is then inserted into the shrink tube and one of the hinged legs of the eyeglasses is inserted in the shrink tube between the friction side of the pad and the side wall of the shrink tube. A heat source is then applied to the shrink tube to secure the hinged leg in the tag assembly. The heat shrinking of the shrink tube also serves to secure the EID in the tag. In another embodiment, the BID is secured to the outside of the shrink tube with, for example, an adhesive such as pressure-sensitive glue.

Referring now to the drawings, FIG. 1 shows an exploded view of the tag assembly 10 that includes the tag 12 having a body 14 and a hook 16 with an information panel 18 in between the body 14 and the hook 16. The body 14 has a front surface 20 and a rear surface 22, as well as a first end 24 and a second end 26. A pair of slotted members 28 extend from the rear surface 22 with the slots 30 facing inwardly, i.e., towards one another.

An EID 32 with information relating to the article attached to the tag assembly 10 can be inserted into the slots 30 of the slotted members 28. A pad 36 having an adhesive side 38 and a friction side 40 is attached to the tag 12 by contacting the adhesive side 38 with the front surface 20 of the body 14.

The body 14 of the tag 12 is inserted into a shrink tube 42 having a side wall 44 and an opening 46 extending between a first end 48 and a second end 50. In the preferred embodiment of the tag assembly 10 shown in FIG. 1, the shrink tube 42 has a flat portion 52 that corresponds to the rear surface 22 of the body 14 of the tag 12. The remaining portion of the side wall 44 is formed by a plurality of panels. After the body 14 passes into the opening 46 in the shrink tube 42, there is sufficient space between the friction side 40 of the pad 36 and the side wall 44 of the shrink tube 42 (see FIGS. 3 and 4) to allow the hinged leg 96 of the eyeglasses 90 to pass through the opening 46 (see FIGS. 11-13).

Figure 2:
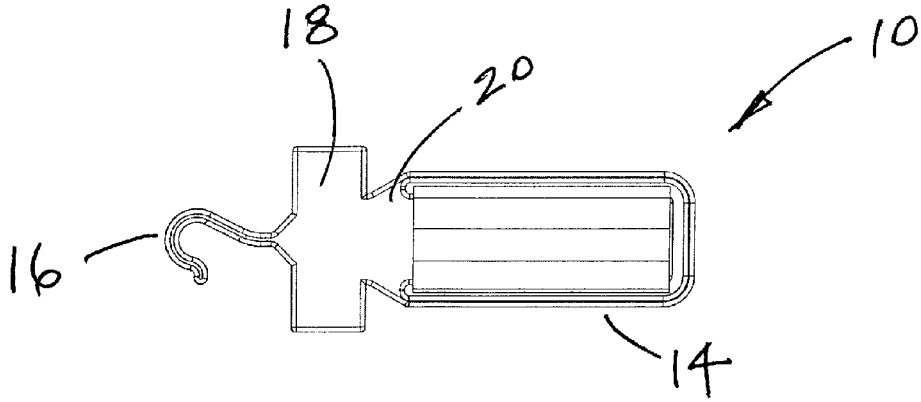
FIG. 2 is a front plan view of the assembled shrink-wrap eyeglasses tag assembly in FIG. 1.
Figure 3:
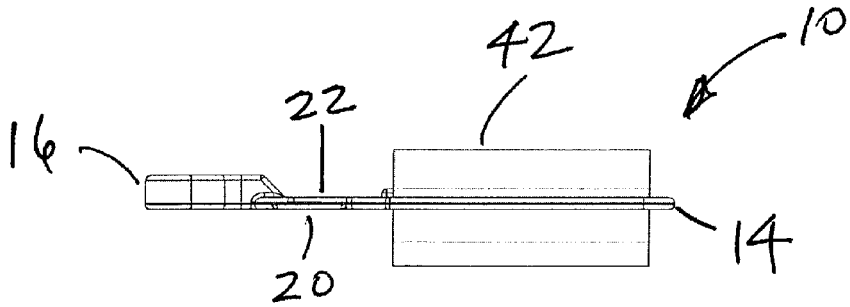
FIG. 3 is a side of the assembled shrink-wrap eyeglasses tag assembly in FIG. 1.
Figure 4:
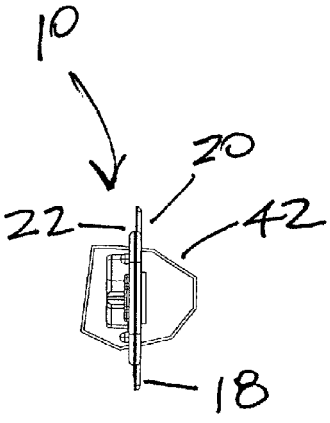
FIG. 4 is an end view of the assembled shrink-wrap eyeglasses tag assembly in FIG. 1.
Figure 5:
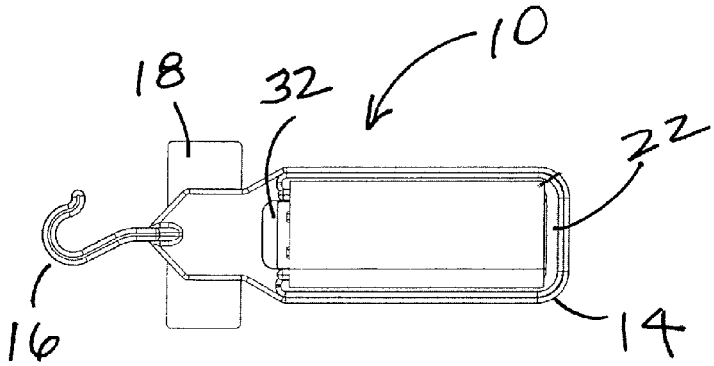
FIG. 5 is a rear plan view of the assembled shrink-wrap eyeglasses tag assembly in FIG. 1.

FIGS. 2-5 show different views of the assembled shrink wrapped eyeglasses tag assembly 10. FIG. 2 is a front plan view of the tag 12 and shows the information panel 18 on the front surface 20 of the body 14. FIG. 3 is a side view of the tag assembly 10 and shows that, after the body 14 is inserted into the shrink tube 42, the opening 46 provides sufficient space for inserting the hinged leg 96 (see FIGS. 11-13) of the eyeglasses 90. FIG. 4 is an end view of the tag assembly 10 and shows how the shrink tube 42 extends beyond the body 14 of the tag 12 before heat is applied to shrink the shrink tube 42 around the hinged leg 96 of the eyeglasses 90. FIG. 5 shows a view of the rear surface 22 of the tag body 14.

Figure 6:
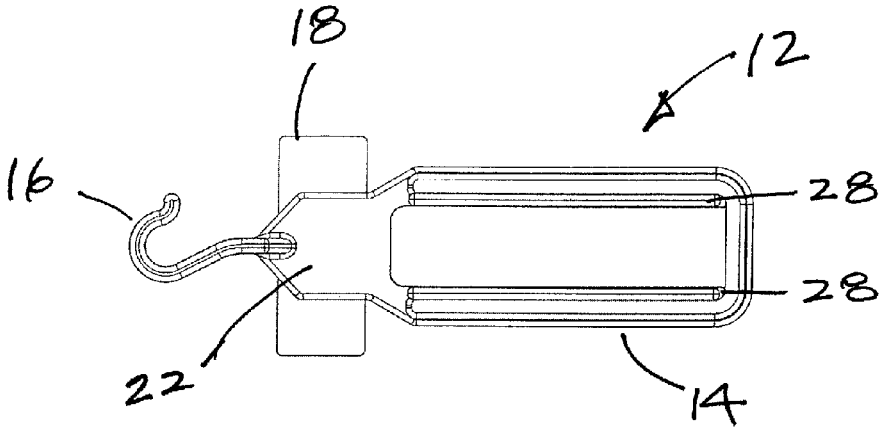
FIG. 6 is a rear view of the tag of the shrink-wrap eyeglasses tag assembly in FIG. 1.
Figure 7:
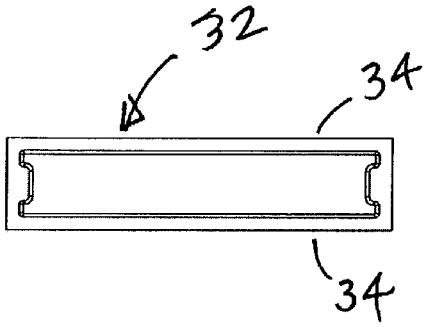
FIG. 7 is a front plan view of the electronic identification device of the shrink-wrap eyeglasses tag in FIG. 1.
Figure 8:
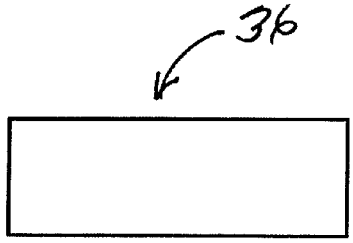
FIG. 8 is a front plan view of the adhesive/friction pad of the shrink-wrap eyeglasses tag assembly in FIG. 1.

FIGS. 6-10 show views of the different components of the tag assembly 10. FIG. 6 shows the rear surface 22 of the tag 12 with the slotted members 28 for attaching the EID 32. FIG. 7 shows the BID 32, which is used to identify the article attached to the tag assembly 10 (see FIGS. 11-13). The opposing side edges 34 of the EID 32 are inserted into the slots 30 of the slotted members 28 to install the BID 32 in the tag 12 (see FIG. 1). FIG. 8 shows the pad 36, which has an adhesive side 38 that is used to attach the pad 36 to the front surface 20 of the body 14 of the tag 12 and a frictional side 40 that grips the hinged leg 96 of the eyeglasses 90. When the shrink tube 42 is shrunk, the hinged leg 96 is pressed against the pad 36 to secure the eyeglasses 90 in the tag assembly 10 (see FIG. 1).

Figure 9:
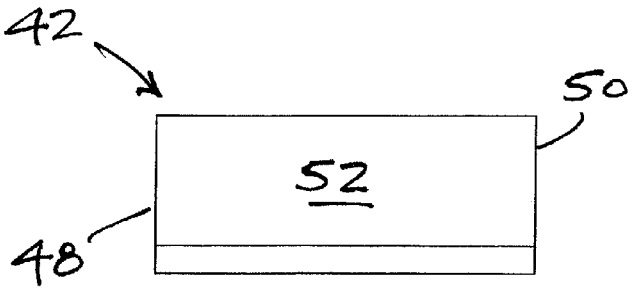
FIG. 9 is a side view of the shrink tube of the shrink-wrap eyeglasses tag assembly in FIG. 1.
Figure 10:
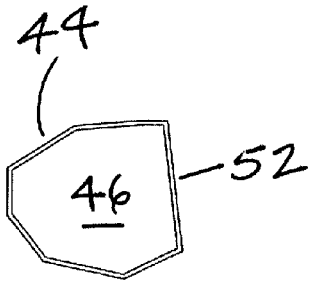
FIG. 10 is an end view of the shrink tube of the shrink-wrap eyeglasses tag assembly in FIG. 1.

FIGS. 9 and 10 show a side view and an end view, respectively, of the shrink tube 42. FIG. 9 shows an embodiment of the shrink tube 42 that has a substantially flat side wall 52. The end view in FIG. 9 illustrates how the shrink tube 42 is substantially shaped like the letter "D" and the side wall 44 is formed by a plurality of flat panel sections. The application of heat collapses the side wall 44 of the shrink tube 42 around the tag 12 and secures the leg 96 of the eyeglasses 90 inserted in the opening 46 of the shrink tube 42 to the body 14 of the tag 12.

Figure 13:
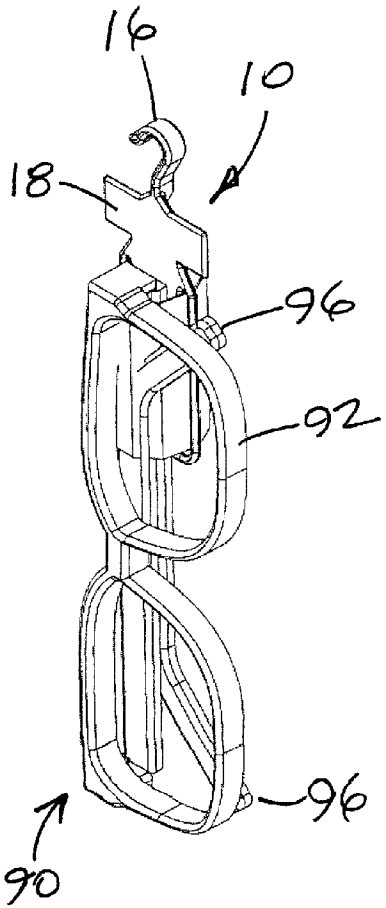
FIG. 13 is a front perspective view of a pair of eyeglasses secured to the shrink-wrap eyeglasses tag assembly in FIG. 1.
Figure 12:
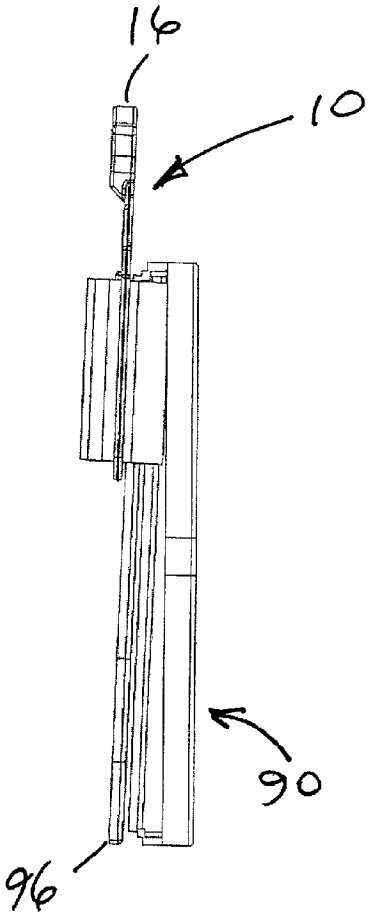
FIG. 12 is a side view of a pair of eyeglasses secured to the shrink-wrap eyeglasses tag assembly in FIG. 1.
Figure 11:
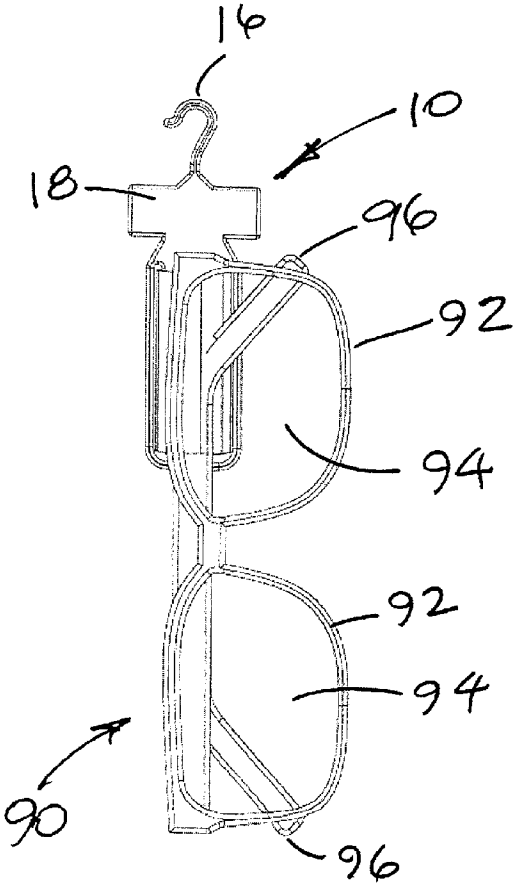
FIG. 11 is a front view of a pair of eyeglasses secured to the shrink-wrap eyeglasses tag assembly in FIG. 1.

FIGS. 11-13 show a front, side and front perspective view of the tag assembly 10 attached to a pair of eyeglasses 90. The eyeglasses 90 include a frame 92 that encloses a pair of lenses 94 and a pair of hinged legs 96. One of the hinged legs 96 is inserted into the opening 46 in the shrink tube 42. Heat is then applied to the shrink tube 42 to snugly shrink the shrink tube 42 around the tag 12 and the hinged leg 96. The shrink tube 42 also secures the EID to the tag 12. The hook 16 of the tag assembly 10 can then be used to hang the tag assembly 10 and eyeglasses 90 in a display.

Figure 14:
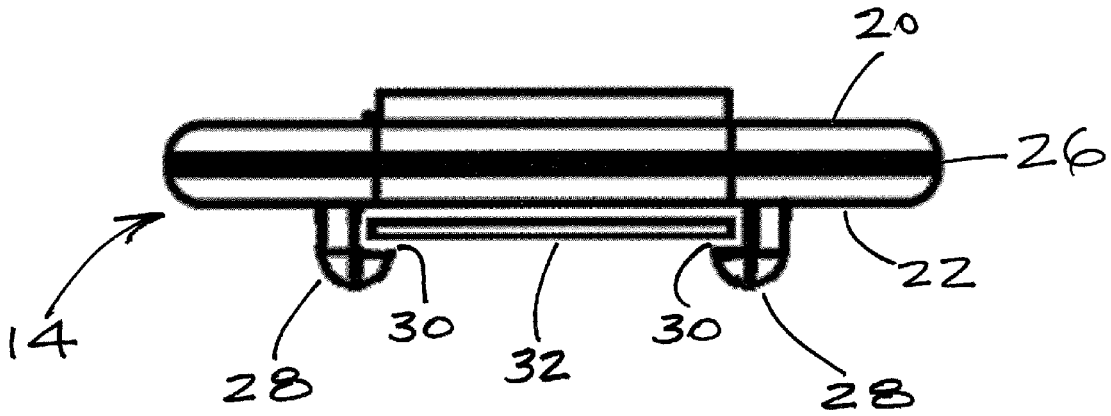
FIG. 14 is an end view of the second end of the body of the shrink-wrap eyeglasses tag in FIG. 1.

FIG. 14 shows an end view of the second end 26 of the body 14 of the tag 12. A pair of slotted members 28 extends downwardly and inwardly from the rear surface 22 of the body 14 to form a pair of slots 30 that face inwardly, towards one another. An EID 32 can be inserted into the slots 30 of the slotted members 28.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A tag assembly for securing a tag to a pair of eyeglasses having a frame, a first hinged leg and a second hinged leg, the tag assembly comprising:

a tag comprising a body having a first end, a second end, a front surface and a rear surface;

a pair of slotted members extending from the rear surface of the body and perpendicular to the ends, wherein each of the slotted members has a slot having opposing open ends and four sides, wherein one side is an open side adjacent to a side formed by the rear surface of the body of the tag and the other two sides are formed by the slotted member, and wherein the open sides of the slots face each other; and a shrink tube having a side wall, a first end, a second end and an opening extending therebetween, wherein the body of the tag is inserted into the opening in the shrink tube and the tag assembly receives one of the first hinged legs of the pair of eyeglasses between the body and the shrink tube, and wherein the shrink tube secures the hinged leg in the tag assembly upon the application of heat.

2. The tag assembly for securing a tag to a pair of eyeglasses according to claim 1, further comprising an electronic identification device having opposing side edges, wherein the opposing side edges of the electronic identification device are inserted into the slotted members of the body.

3. The tag assembly for securing a tag to a pair of eyeglasses according to claim 2, wherein the electronic identification device is a radio frequency identification (RFID) device or an electronic article surveillance (EAS) device.

4. The tag assembly for securing a tag to a pair of eyeglasses according to claim 1, further comprising a hook extending arcuately from the first end of the body to a distal end.

5. The tag assembly for securing a tag to a pair of eyeglasses according to claim 4, further comprising an information panel located on the first end of the body.

6. The tag assembly for securing a tag to a pair of eyeglasses according to claim 1, further comprising a substantially flat pad having a first adhesive side and a second friction side, wherein the adhesive side of the pad is placed in contact with the front surface of the body to secure the pad to the body.

7. The tag assembly for securing a tag to a pair of eyeglasses according to claim 6, wherein the first hinged leg is received between the friction side of the pad and the shrink tube.

8. The tag assembly for securing a tag to a pair of eyeglasses according to claim 1, wherein the shrink tube is made from polypropylene, polyvinyl chloride (PVC) or polyethylene.

9. The tag assembly for securing a tag to a pair of eyeglasses according to claim 1, wherein the body has a length and the shrink tube has a length and the lengths are substantially the same.

10. The tag assembly for securing a tag to a pair of eyeglasses according to claim 1, wherein the pair of slotted members are substantially parallel to each other and the slots are located on the sides of the slotted members and face each other.

11. A tag assembly for securing a tag to a pair of eyeglasses having a frame, a first hinged leg and a second hinged leg, the tag assembly comprising:

a tag comprising a body having a first end, a second end, a front surface and a rear surface and a hook extending arcuately from the first end to a distal end;

a pair of slotted members extending from the rear surface of the body and perpendicular to the ends, wherein each of the slotted members has a slot having opposing open ends and four sides, wherein one side is an open side adjacent to a side formed by the rear surface of the body of the tag and the other two sides are formed by the slotted member, and wherein the open sides of the slots face each other;

an electronic identification device having opposing side edges; and a shrink tube having a side wall, a first end, a second end and an opening extending therebetween, wherein the opposing side edges of the electronic identification device are inserted into the slotted members of the body, wherein the body of the tag is inserted into the opening in the shrink tube and the tag assembly receives one of the first hinged legs of the pair of eyeglasses between the body and the shrink tube, and wherein the shrink tube secures the hinged leg in the tag assembly upon the application of heat.

12. The tag assembly for securing a tag to a pair of eyeglasses according to claim 11, wherein the electronic identification device is a radio frequency identification (RFID) device or an electronic article surveillance (EAS) device.

13. The tag assembly for securing a tag to a pair of eyeglasses according to claim 11, further comprising an information panel located on the first end of the body.

14. The tag assembly for securing a tag to a pair of eyeglasses according to claim 11, further comprising a substantially flat pad having a first adhesive side and a second friction side, wherein the adhesive side of the pad is placed in contact with the front surface of the body and is adapted to secure the pad to the body.

15. The tag assembly for securing a tag to a pair of eyeglasses according to claim 14, wherein the first hinged leg is received between the friction side of the pad and the shrink tube.

16. The tag assembly for securing a tag to a pair of eyeglasses according to claim 11, wherein the shrink tube is made from polypropylene, polyvinyl chloride (PVC) or polyethylene.

17. The tag assembly for securing a tag to a pair of eyeglasses according to claim 11, wherein the body has a length and the shrink tube has a length and the lengths are substantially the same.

18. The tag assembly for securing a tag to a pair of eyeglasses according to claim 11, wherein the pair of slotted members are substantially parallel to each other and the slots are located on the sides of the slotted members and face each other.

19. A tag assembly for securing a tag to a pair of eyeglasses having a frame, a first hinged leg and a second hinged leg, the tag assembly comprising:

a tag comprising a body having a first end, a second end, a front surface and a rear surface and a hook extending arcuately from the first end to a distal end;

a pair of slotted members extending from the rear surface of the body and perpendicular to the ends, wherein each of the slotted members has a slot having opposing open ends and four sides, wherein one side is an open side adjacent to a side formed by the rear surface of the body of the tag and the other two sides are formed by the slotted member, and wherein the pair of slotted members are substantially parallel to each other and the slots are located on the sides of the slotted members and face each other;

a radio frequency identification (RFID) device or an electronic article surveillance (EAS) device having opposing side edges;

a substantially flat pad having a first adhesive side and a second friction side, wherein the adhesive side of the pad contacts the front surface of the body; and a shrink tube having a side wall, a first end, a second end and an opening extending therebetween, wherein the shrink tube is made from polypropylene, polyvinyl chloride (PVC) or polyethylene, wherein the opposing side edges of the electronic identification device are inserted into the slotted members of the body, wherein the body of the tag is inserted into the opening in the shrink tube, wherein the first hinged leg is received between the friction side of the pad and the shrink tube, and wherein the shrink tube secures the hinged leg in the tag assembly upon the application of heat.

20. The tag assembly for securing a tag to a pair of eyeglasses according to claim 19, further comprising an information panel located on the first end of the body.

* * * * *

UNITED STATES PATENT AND TRADEMARK OFFICE

CERTIFICATE OF CORRECTION

PATENT NO. : 8,646,199 B2
APPLICATION NO. : 13/215574
DATED : February 11, 2014
INVENTOR(S) : Norman et al.

It is certified that error appears in the above-identified patent and that said Letters Patent is hereby corrected as shown below:

IN THE SPECIFICATION:

Column 1, line 38:
Now reads: "ED"
Should read: -- EID --

Column 2, line 27:
Now reads: "BID"
Should read: -- EID --

Column 4, line 5:
Now reads: "BID"
Should read: -- EID --

Column 4, line 48:
Now reads: "BID"
Should read: -- EID --

Column 4, line 51:
Now reads: "BID"
Should read: -- EID --

Signed and Sealed this
Twenty-second Day of July, 2014

Michelle K. Lee

Michelle K. Lee
*Deputy Director of the United States Patent and Trademark Office*